US007926515B2

(12) United States Patent
Jung et al.

(10) Patent No.: US 7,926,515 B2
(45) Date of Patent: Apr. 19, 2011

(54) MODULAR UNIT

(75) Inventors: Artur Jung, Quierschied (DE); Norbert Sann, Riegelsberg (DE)

(73) Assignee: Hydac Filtertechnik GmbH, Sulzbach/Saar (DE)

( * ) Notice: Subject to any disclaimer, the term of this patent is extended or adjusted under 35 U.S.C. 154(b) by 941 days.

(21) Appl. No.: 11/629,752

(22) PCT Filed: Apr. 26, 2005

(86) PCT No.: PCT/EP2005/004442

§ 371 (c)(1),
(2), (4) Date: May 18, 2007

(87) PCT Pub. No.: WO2005/124162

PCT Pub. Date: Dec. 29, 2005

(65) Prior Publication Data

US 2007/0261737 A1 Nov. 15, 2007

(30) Foreign Application Priority Data

Jun. 17, 2004 (DE) ..... 10 2004 040 909

(51) Int. Cl.
*F15B 13/00* (2006.01)

(52) U.S. Cl. ..... 137/884; 210/416.5

(58) Field of Classification Search ..... 137/565.16, 137/565.17, 565.19, 884; 210/171.6, 181, 210/186, 416.5

See application file for complete search history.

(56) References Cited

U.S. PATENT DOCUMENTS

| | | | | |
|---|---|---|---|---|
| 1,901,484 | A * | 3/1933 | Winslow et al. | 210/133 |
| 2,068,395 | A * | 1/1937 | Burckhalter et al. | 210/181 |
| 3,053,389 | A * | 9/1962 | Rosaen et al. | 210/90 |
| 3,463,317 | A * | 8/1969 | Prier | 210/181 |
| 3,515,167 | A * | 6/1970 | Svenson | 137/565.17 |
| 3,586,169 | A * | 6/1971 | Hultquist | 210/90 |
| 3,589,387 | A | 6/1971 | Raymond | |
| 3,730,260 | A | 5/1973 | Raymond | |
| 4,585,398 | A * | 4/1986 | Drake | 417/367 |
| 4,627,793 | A * | 12/1986 | Kuroyanagi et al. | 417/203 |
| D288,283 | S * | 2/1987 | Mattson | D8/373 |
| 4,964,376 | A | 10/1990 | Veach et al. | |
| 5,139,658 | A * | 8/1992 | Hodge | 210/167.01 |
| 5,413,716 | A * | 5/1995 | Osborne | 210/787 |
| 6,371,005 | B1 * | 4/2002 | Foschini et al. | 91/418 |
| 6,568,919 | B1 * | 5/2003 | Fletcher et al. | 417/307 |
| 6,978,608 | B2 * | 12/2005 | Dantlgraber | 60/454 |
| 7,354,511 | B2 * | 4/2008 | Becker | 210/167.02 |
| 2003/0047218 | A1 * | 3/2003 | Cook | 137/565.19 |

FOREIGN PATENT DOCUMENTS

| | | |
|---|---|---|
| DE | 32 27 926 | 2/1984 |
| DE | 199 50 052 | 5/2001 |
| WO | WO 98/42986 | 10/1998 |
| WO | WO 01/18363 | 3/2001 |

* cited by examiner

*Primary Examiner* — John K Fristoe, Jr.

*Assistant Examiner* — Marina Tietjen

(74) *Attorney, Agent, or Firm* — Roylance, Abrams, Berdo & Goodman, LLP

(57) ABSTRACT

A modular unit has at least one filter (10), pump (12) and cooling unit (14) fluidically connected to each other by a connection module (16) and connected to a tank unit (18). The connection module (16) opens out inside (22) the tank unit with a suction opening (20), together with the cooling unit (14) when the tank unit is connected (18). The filter unit (10) and pump unit (12) are arranged outside the tank unit (18). The modular unit can then be placed on and connected to a tank unit. The cooling unit protrudes inside the tank unit.

7 Claims, 3 Drawing Sheets

MODULAR UNIT

FIELD OF THE INVENTION

The present invention relates to a modular unit having at least one filter unit, one pump unit and one cooling unit connected to each other to carry fluid by a connecting module and connected to a tank unit.

BACKGROUND OF THE INVENTION

WO 98/42986 A1 discloses a fluid cooling device as a modular unit with a motor which drives a fan wheel and a fluid pump which takes fluid from an oil tank and delivers it to a hydraulic working circuit which heats the fluid. The fluid pump routes the fluid to a heat exchanger (cooling unit). From the heat exchanger the cooled fluid is returned to the oil tank. The oil tank is made trough-shaped and with raised trough edges partially encompassing at least the motor and the fluid pump in the shape of a half shell. With the known solution, the actual modular unit of a filter unit, a pump unit and a cooling unit can be connected in a space-saving manner to a relatively high-volume oil tank as the tank unit. From the installation space left free by the trough edges of the oil tank, good accessibility of the remaining modular unit is ensured for mounting and maintenance purposes. The known fluid cooling device for the most part avoids additional tubing. Avoiding additional tubing helps save costs and is energy-efficient, because losses in the fluid lines are avoided. Regardless, the known fluid cooling device can be sold only as an integral modular unit of the combination of filter unit, pump unit, cooling unit and tank unit. In particular, retrofitting onto existing oil tanks or tank units with the further modular unit is hardly possible. Since these tank units and oil tank units often originate from other manufacturers and are already on site, depending on the respective application it would be desirable to retrofit these units with a modular unit of a filter unit, a pump unit and a cooling unit as required, or if necessary to undertake modifications such that one fluid cooling device is replaced by a new one, for example, with greater capacity. In this connection, the respective tank unit remains on site.

Accordingly, the prior art (WO 01/18363 A1) discloses connecting fluid cooling devices as modular units to oil tanks or tank units provided separately from them. The known solution relates to a fluid cooling device with a cooling means, filter means, and pump means combined into a modular unit. The fluid conveyed in the fluid circuit by the pump means is filterable by the filter means and coolable by the cooling means. The filter means has at least one filter element which can be replaced when it is fouled. In that in the known solution for the replacement of the respective filter element in the fluid circuit, an actuatable blocking means is present with which the filter means can be separated from the pump means such that the cooling means is further supplied with the fluid to be cooled. It is possible in the known solution to enable the filter element replacement without additional effort even if the downstream lubricating oil supply is not shut off. The known fluid cooling device can be connected as a modular unit, depending on its capacity, to any oil tanks or tank units. For this purpose, the corresponding tubing or fluid-carrying lines, between the modular unit and the tank unit are necessary. As already explained, this tubing is associated with the corresponding complexity in terms of production and installation. This tubing also raises costs, and flow resistances arise due to the length of the fluid lines provided between the modular unit and the tank unit. This arrangement has adverse effects on the energy-efficient operation of the means as a whole. The additional fluid lines also result in increased installation space. In applications in automotive and mechanical engineering and apparatus engineering, this arrangement often leads to problems, where often there is only little installation space due to given boundary conditions.

SUMMARY OF THE INVENTION

An object of the present invention is to provide improved modular units that are compact, can be retrofitted onto existing tank units and are interchangeable, and permit energy-efficient operation and economical implementation.

This object is basically achieved by a modular unit having a connecting module with a tank unit connected and with an intake opening together with a cooling unit discharging into the interior of the tank unit. A filter unit and pump unit are located outside the tank unit. The modular unit can be placed on the tank unit, for example, in the form of an oil tank, and can be connected to it. The cooling unit projects into the interior of the tank unit. Accordingly, the intake opening also projects into the interior of the tank and in this way enables continuing removal of the fluid stored in the tank unit by the pump unit. The other units (filter unit and pump unit) are located to be easily accessibly outside the tank unit. Piping in the form of fluid lines between the modular unit and the tank unit can be avoided by direct placement and engagement of the modular unit on or with the tank unit. The modular unit is preferably located on a side wall of the tank unit.

By fluid removal via the intake opening within the tank unit the free fluid paths are clearly reduced compared to known solutions to benefit energy-efficient operation of the overall modular unit. Furthermore, the design of the present invention is compact and can be easily replaced by a new modular unit, for example, one with greater performance capacity, if this should be necessary. Energy-efficient operation of the overall modular unit is also benefited by the cooling unit discharging into the interior of the medium of the tank unit to be cooled, so that the medium cooled directly via the cooling unit can be further routed on to the tank unit. In this way, a uniform temperature is present within the tank unit to enable defined fluid removal by the pump unit.

In one preferred embodiment of the modular unit of the present invention, at least two, preferably three units extending at a right angle to one another are connected to the connecting module. Preferably, the connecting module has an angular housing with two connecting arms extending at a right angle to one another and has at least one additionally arranged flange part. In this way, the individual units of the modular unit can be arranged relative to one another in the form of a T-module or in the manner of a Cartesian coordinate system. This arrangement in turn helps shorten the free fluid paths within the connecting module and helps save installation space on the tank unit. Based on the configuration of the connecting module with connecting arms and a flange part, in special cases other connection possibilities for other components can be devised, for example, in the form of a second filter element or the like.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure and which are schematic and not drawn to scale.

DETAILED DESCRIPTION OF THE INVENTION

Figure 1:
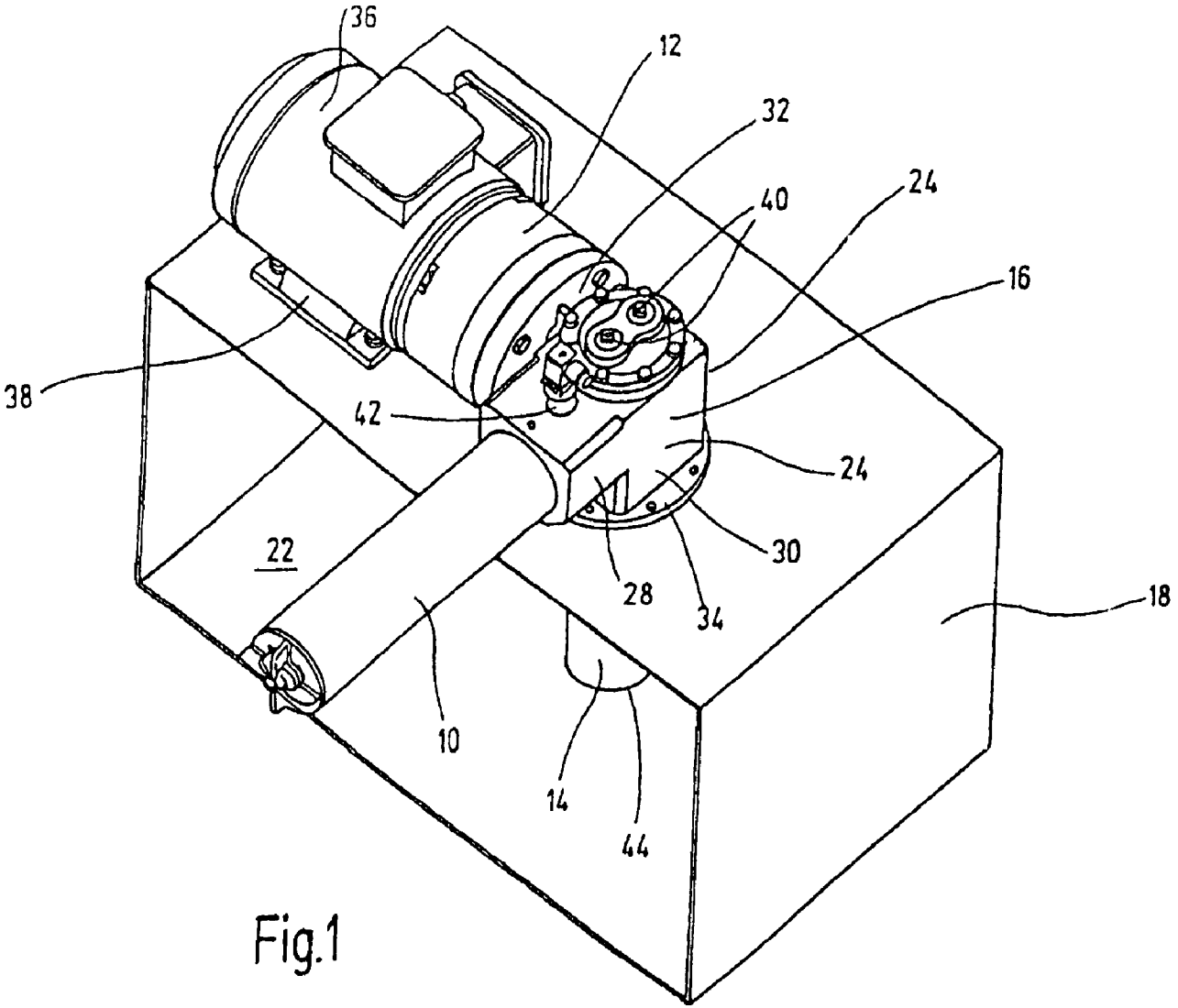
FIG. 1 is a perspective view of the modular unit connected to a tank unit according to an exemplary embodiment of the present invention.

The modular unit shown as a whole in FIG. 1 has a filter unit 10, a pump unit 12 and a cooling unit 14 (shown only partially). These units can be connected to one another to carry fluid by a connecting module 16 and can be connected to a tank unit 18. The tank unit 18 preferably constitutes an oil tank with hydraulic oil as the fluid medium. The modular unit of the present invention can also be used for other fluid media, such as water, special alcohols, gasoline, etc. The tank unit 18 shown in FIG. 1 is made as a rectangular container, the face-side wall toward the viewer having been omitted to illustrate the engagement of the cooling unit 14 with the tank unit 18.

Figure 4:
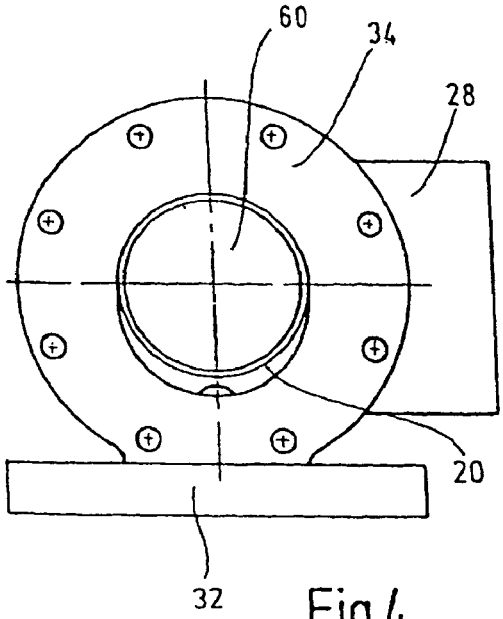
FIG. 4 is a bottom plan view of the connecting module of FIG. 2.
Figure 5:
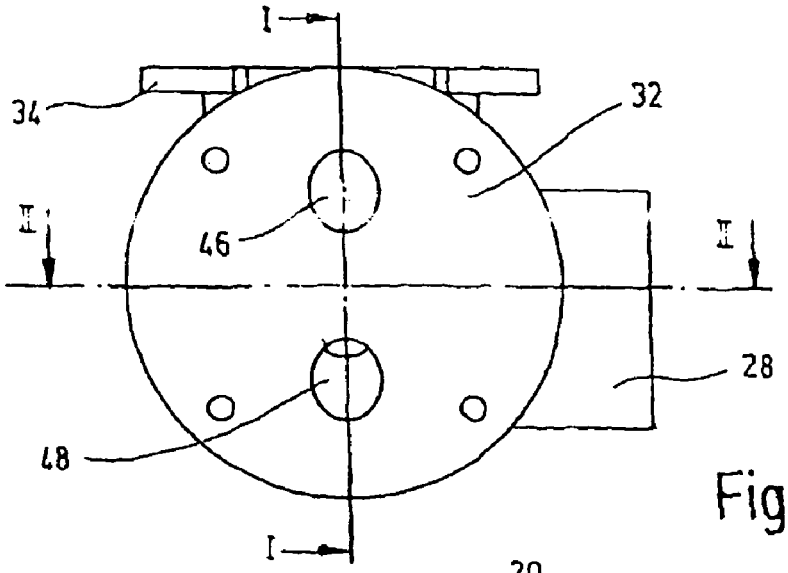
FIG. 5 is a side elevational view of the connecting module of FIG. 3.
Figure 6:
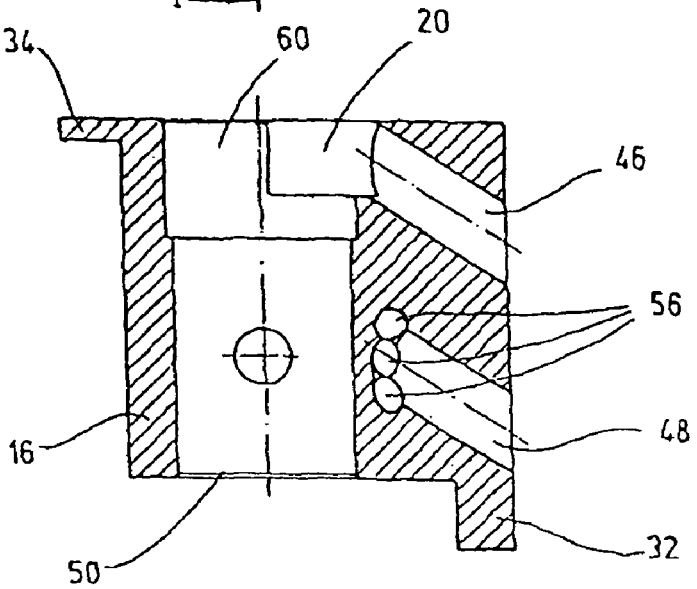
FIG. 6 is a rear elevational view in section along line I-I of FIG. 5.
Figure 7:
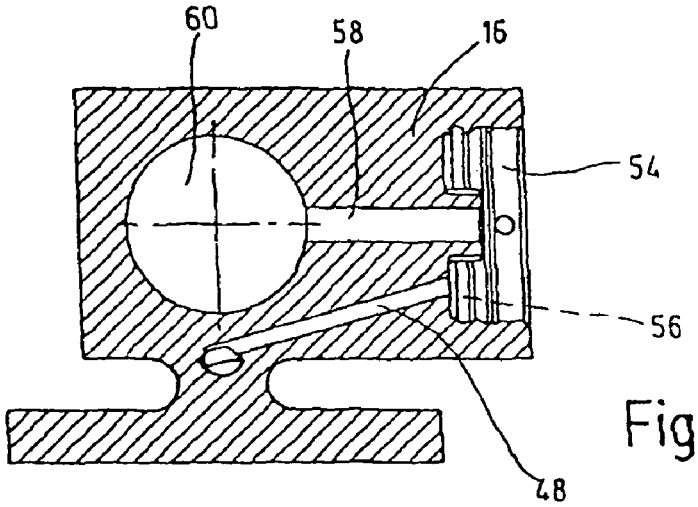
FIG. 7 is a top plan view in section taken along line II-II of FIG. 5.

The connecting module 16 with the tank unit 18 connected projects with an intake opening 20 (compare FIGS. 4 and 6) together with the cooling unit 14 into the interior 22 of the tank unit 18. The pump unit 12 is located outside of the tank unit 18. In the embodiment as shown in FIG. 1, the three units 10, 12, 14 running or extending at a right angle to one another are connected to the connecting module 16 to span a type of imaginary Cartesian coordinate system. In another embodiment of the modular unit (not shown), the filter unit 10 can be attached in the longitudinal axis to the pump unit 12 on the opposite side of the connecting module 16 so that in this respect all three units 10, 12, 14 would form a type of T-shape. Furthermore, the possibility exists of attaching other functional units to the walls 24 of the connecting module housing 26 remaining free, for example, in the form of other filter units, heat exchangers, or the like.

The housing 26 of the connecting module 16 is made angular and has two connecting arms 28, 30 extending at a right angle to one another. The filter unit 10 is connected to the arm 28, while the other second connecting arm 30 forms a connection for the cooling unit 14. The connecting module 16 facing the pump unit 12 has a pump flange 32, and facing the cooling unit 14 between the tank unit 18 and the connecting aim 30 has a tank flange 34. The tank flange 34 can detachably connect the modular unit to the tank unit. The pump unit 12 on its side facing away from the pump flange 32 has a drive motor 36 for the pump unit 12, preferably in the form of an electric motor. As shown in FIG. 1, the drive motor 36 can be connected to the top of the tank unit 18 by a base element 38, in the same manner as the tank flange 34. The connecting module 16 on its side opposite the cooling unit 14 has connection sites 40 for a cooling medium. In order to have a possibility for display of the degree of fouling of the filter element of the filter unit 10, on the upper side of the connecting module 16 seen in FIG. 1 there is a fouling display 42.

With the modular unit of the present invention shown in FIG. 1, the fluid medium stored in the tank unit 18 can be removed by the intake opening 20 and routed separately to the cooling unit 14 by the pump unit 12, then to filter the medium removed by the filter unit 10 and to return the medium which has been filtered to the tank unit 18 by the cooling unit 14. The cooling unit is preferably a tube bundle cooler. The structure of this cooler is conventional and will not be described in detail. The cooled medium is discharged via a discharge opening 44 on the underside of the tube bundle cooler in the form of a cylindrical cooling unit 14. Each respective unit 10, 12, 14, except for the tank unit 18, is made with cylindrical connecting parts for the connecting module 16. If the modular unit is to be removed from the tank unit 18, this removal is easily possible after releasing the screw connection on the tank flange 34 and the base element 38 of the drive motor 36. The modular unit can be left on the tank unit 18, and, for example, to replace a fouled filter element of the filter unit 10 for maintenance purposes by removing or decoupling the housing and/or parts of the housing, such as, for example, the cover of the filter unit 10, accordingly from the connecting module 16.

Figure 2:
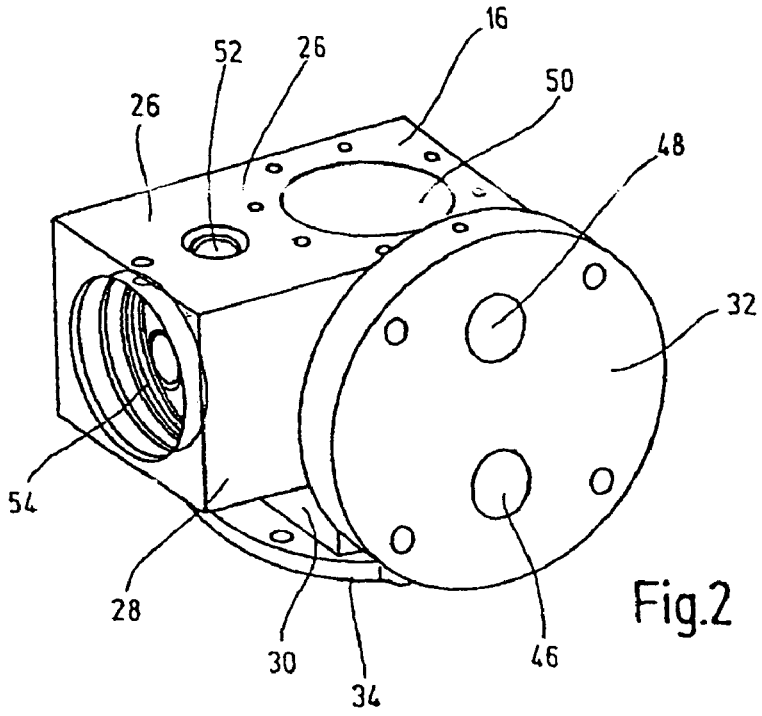
FIG. 2 is a perspective view of the connecting module of the modular unit of FIG. 1.

To illustrate fluid routing between the units 10, 12 14 and within the connecting module 16, the connecting module 16 shown in FIG. 2 is shown in sections and in different views in FIGS. 3-7. The connecting module 16 is shown in FIG. 2 with the housing 26 having the two connecting arms 28, 30. Facing the viewer of FIG. 2, on the side wall of the connecting module 16 is the pump flange 32. As the lower termination of the arm 30, the tank flange 34 is connected to the connecting module 16. The pump flange 32 has two fluid passage openings. As viewed in FIG. 2, the intake connection 46 is located underneath, and, overhead in a vertical plane, the pressure connection 48 lies. By the pertinent connections 46, 48, fluid circulation is possible by the motor pump unit 36, 12. Viewed in FIG. 2 at the top in the housing 26, connecting opening 50 is for the connection sites 40 of the cooling medium, and a screw-in opening 52 is for the fouling display 42. On the forward or front face of the housing 26, the mounting opening 54 is provided for the housing of the filter unit 10.

Figure 3:
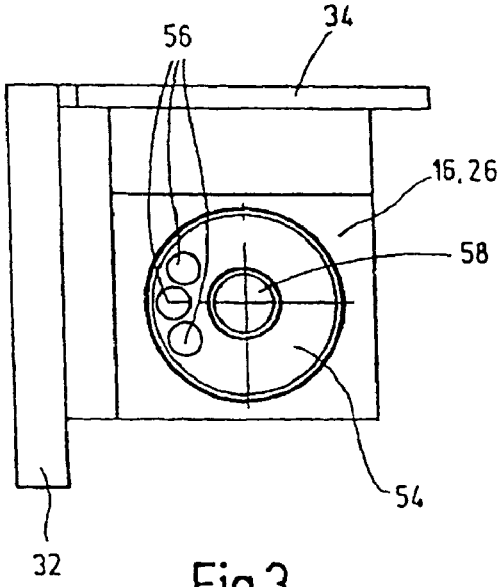
FIG. 3 is a front elevational view of the connecting module of FIG. 2.

As shown especially by FIG. 3, in the area of the mounting opening 54 for the filter unit 10 within the housing 26, the pressure connection 48 of the pump unit 12 discharges into the housing 26. The pressure connection 48 is divided into three distributor openings 56 (see also FIG. 6). This distribution yields an improved, uniform distribution of the fluid flow into the pertinent filter unit 10. By these distributor openings 56, fouled fluid travels to the filter element of the filter unit 10, and the cleaned fluid travels via the filter element back into a collecting opening 58 (compare FIG. 3) to which the cooling unit 14 is connected to carry fluid. The medium cleaned in this way via the filter unit 10 then travels via the collecting opening 58 into the cooling unit 14. From the cooling unit 14, the cooled fluid is conveyed via the discharge opening 44 back into the interior 22 of the tank unit 18. In the bottom view of the tank flange 34 of FIG. 4, a through opening 60 accommodates the cooling unit 14. As viewed in FIG. 4, the lower receiving circuit of through opening 60 is widened by the intake opening 20. In this respect on the bottom of the tank flange 34 the intake opening 20 discharges into the through opening 60 (compare FIG. 6). As FIG. 4 furthermore shows, the pressure connection 48 conversely ends on the inside wall of the housing 26 of the connecting module 16. In this way, via the distributor openings 56, the fluid flow originating from the pressure connection 48 is delivered directly into the filter unit 10 for a cleaning process.

In the present invention, the intake opening 20 is located in a plane-parallel termination to the bottom of the tank flange 34. If the modular unit as shown in FIG. 1 is placed on the tank unit 18 from the top, care should be taken that the tank unit 18 is also filled to the full extent with the fluid medium, so that fluid can be removed via the pump unit 12 by the tank flange 34 directly on the underside of the container wall of the tank unit 18. The possibility also exists in an embodiment (not shown) to lengthen this intake opening 20 to the bottom in the direction of the free end of the cooling unit 14. This lengthening may mean that an additional component in the form of an intake pipe or the like would have to be used. Preferably, the modular unit is attached laterally to the tank unit 18, this typical installation situation being implemented when the subject matter as shown in FIG. 1 is pivoted counterclockwise by 90° in the direction of viewing, so that the side designation ⅓ then points to the top. In this case, filling of the tank unit 18 only up to the intake opening 20 of the tank flange 34 would be necessary. Other installation possibilities can be implemented. With the modular unit of the present invention, it is possible to provide a connection to almost any tank unit 18 without further piping in the form of fluid lines to perform pumping, filtering and cooling of the stored medium. Furthermore it is possible, in terms of a hydraulic circuit to move the medium by the motor pump unit out of the tank unit 18 to elsewhere, for example, for operation of a machine (not shown) and to discharge the fluid which may be fouled and which has then been heated in this way from the modular unit to be cooled and cleaned and then conveyed to the tank unit 19 for recirculation.

While one embodiment has been chosen to illustrate the invention, it will be understood by those skilled in the art that various changes and modifications can be made therein without departing from the scope of the invention as defined in the appended claims.

What is claimed is:

1. A modular unit, comprising:

a filter unit;

a pump unit;

a cooling unit;

a tank unit with a tank interior;

a connecting module connecting said units together by being directly connected thereto and in fluid communication with one another through said connecting module, said connecting module having an intake opening connected to and opening into said tank interior, said filter unit and said pump unit being connected to said connecting module at a location outside of said tank unit, said cooling unit being connected to said connecting module at a location within said tank interior, said filter unit, said pump unit and said cooling unit extending at right angles to one another from said connecting module, said connecting module including an angular housing having first and second connecting arms extending at a right angle to one another, including a pump flange coupled to said pump unit and including a tank flange coupled to said tank unit.

2. A modular unit according to claim 1 wherein said connecting module comprises one side coupled to said cooling unit and an opposite side thereof with connecting sites for cooling medium.

3. A modular unit according to claim 1 wherein an electric drive motor is coupled to said pump unit on a side thereof opposite to said connecting module.

4. A modular unit according to claim 1 wherein said connecting module comprises a housing with said intake opening therein; and said pump unit comprises an intake connection opening into said intake opening in said housing.

5. A modular unit according to claim 1 wherein said filter unit comprises a filter housing; and said pump unit comprises a pressure connection discharging into said filter housing.

6. A modular unit according to claim 1 wherein each of said filter unit, said pump unit and said cooling unit are cylindrical connecting parts.

7. A modular unit according to claim 1 wherein said connecting module comprises a housing with said intake opening and a through opening therein, said intake opening extending into said through opening; and said filter unit and said cooling unit are connected to said through opening.

* * * * *